United States Patent [19]

Vogel et al.

[11] Patent Number: 4,629,094

[45] Date of Patent: Dec. 16, 1986

[54] ADHESIVE APPLICATOR

[75] Inventors: Hans-Günter Vogel, Eschborn; Kurt Müller; Karl Gnewikow, both of Frankfurt am Main, all of Fed. Rep. of Germany

[73] Assignee: Rutgerswerke Aktiengesellschaft, Fed. Rep. of Germany

[21] Appl. No.: 762,695

[22] Filed: Aug. 5, 1985

Related U.S. Application Data

[63] Continuation of Ser. No. 641,973, Aug. 17, 1984, abandoned, which is a continuation of Ser. No. 546,467, Oct. 28, 1983, abandoned, which is a continuation of Ser. No. 268,131, May 29, 1981, abandoned.

[30] Foreign Application Priority Data

Jun. 7, 1980 [DE] Fed. Rep. of Germany ..... 3021541

[51] Int. Cl.[4] ..... A01C 15/00

[52] U.S. Cl. ..... 222/82; 222/146.5; 222/413; 222/612; 401/48

[58] Field of Search ..... 404/107; 222/81–82, 222/88, 202, 207, 216, 225, 236, 255, 146.5, 611–612, 623–624, 511, 517, 575, 566, 372, 410, 412–413; 401/48, 264

[56] References Cited

U.S. PATENT DOCUMENTS

| | | | |
|---|---|---|---|
| 2,815,885 | 12/1957 | Haas | 222/82 |
| 3,135,430 | 6/1964 | Caldwell | 401/48 X |
| 3,193,145 | 7/1965 | Vara | 222/82 |
| 3,243,084 | 3/1966 | Stegner | 222/95 |
| 3,334,792 | 8/1967 | De Vries et al. | 401/48 X |
| 3,562,808 | 2/1971 | Whitley | 222/611 X |
| 3,792,801 | 2/1974 | Baker et al. | 222/146.5 |
| 3,853,410 | 12/1974 | Busoni | 401/1 |
| 3,874,593 | 4/1975 | Wilt | 222/612 X |
| 4,096,973 | 6/1978 | Checko | 222/146.5 |

FOREIGN PATENT DOCUMENTS

| | | | |
|---|---|---|---|
| 328049 | 10/1903 | France | 401/48 |

*Primary Examiner*—H. Grant Skaggs
*Assistant Examiner*—Michael S. Huppert
*Attorney, Agent, or Firm*—Bierman & Muserlian

[57] ABSTRACT

An apparatus for applying adhesive or adhesive pastes in strips on construction or building surfaces comprising a heated hopper container for adhesive mounted on a traveling positive displacement pump, a manifold at the pump outlet provided with a plurality of moveable outlet openings and connected to separate conveying tubes and application nozzles, the positive displacement pump having a widened intake cross-section or a feed screw with a widened in-take cross-section and the hopper having a cylindrical upper section and a lower section conical in only one plane with a heatable screen grid in the transition point between the upper and lower hopper sections, the feed screw and the pump being at least partially heated, the drive shaft of the pump being provided with a safety crank and thermostatically controlled heating element and the hopper being provided with a closable by-pass carrying 2 or more individually or jointly, adjustable horizontally and vertically and elastically rotable slot nozzles mounted sliding on the base.

8 Claims, 5 Drawing Figures

ADHESIVE APPLICATOR

This application is a continuation of Applicants' parent application Ser. No. 641,973 filed Aug. 17, 1984, abandoned, which is a continuation of application Ser. No. 546,467 filed Oct. 28, 1983, abandoned, which is a continuation of application Ser. No. 268,131 filed May 29, 1981, abandoned, which in turn claims the foreign priority of German application Ser. No. P 30 21 541.9 filed June 7, 1980.

STATE OF THE ART

It is known to secure roofing surfaces, rollable heating insulating surfaces and heating insulating boards onto roof surfaces with adhesive strips which are about 4 cm wide and a few millimeters thick. The adhesive strips are usually applied to the roof surface with a pneumatic spray gun and the material to be secured to the roof surface is then pressed onto the adhesive strips to become fixed to the roof surface.

The adhesive compositions are usually packaged in sausage-type plastic covers like a chrysalis which normally do not weigh more than 5 kilograms so they may be easily handled. This means that a continuous adhesive strip is difficult to form as the process is constantly interrupted to replace the rapidly consumed adhesive with a new package which requires a setting period.

A known apparatus for the application of bituminous cold-setting adhesives to a surface is comprised of a heated hopper mounted on a traveling positive displacement pump which is connected by a manifold to a plurality of moveable outlet openings. This apparatus suffers from the disadvantage that the cold and viscous adhesives in the hopper can not be maintained in a completely pumpable condition at low winter temperatures. Moreover, the adhesives dispensed by the apparatus is in the form of round strands which must subsequently be flattened out and the initial adhesion of the adhesive to the base surface which is absolutely necessary is insufficient.

OBJECTS OF THE INVENTION

It is an object of the invention to provide a novel apparatus with a positive displacement pump for the application of adhesives and highly viscous adhesive pastes in strips which can be applied with good adhesion even under cold or wet conditions.

It is a further object of the invention to provide a novel apparatus for the application of flat adhesive strips onto building surfaces using large packages of adhesive so that long working cycles are possible.

These and other objects and advantages of the invention will become obvious from the following detailed description.

THE INVENTION

The novel apparatus of the invention for applying adhesive or adhesive pastes in the strips on construction or building surfaces is comprised of a heated hopper container for adhesive mounted on a traveling positive displacement pump, a manifold at the pump outlet provided with a plurality of moveable outlet openings and means connecting separate conveying tubes and application nozzles, the positive displacement pump having a widened intake cross-section or a feed screw with a widened intake cross-section and the hopper having a cylindrical upper section and a lower section conical in only one plane with a heatable screen grid in the transition point between the upper and lower hopper sections, the feed screw and the pump being at least partially heated, the drive shaft of the pump being provided with a starting crank and a thermostatically controlled heating means and the hopper being provided with a closable by-pass carrying 2 or more individually or jointly, adjustable horizontally and vertically and elastically rotable slot nozzles slidably mounted sliding on the base. The inlet section of the displacement pump is preferably 40 to 50 centimeters by 15 centimeters.

The pump feeding hopper is of a sufficient size to accommodate a large tin or plastic bag containing the adhesive and in the case of the plastic bag, means are provided for automatically opening the lower end of the bag facing the pump and the hopper is provided with a weighted plate on the top of the plastic bag. The weighted plate acts to force the adhesive into the pump and to remove any adhesive adhering to the inner walls of the hopper. In the case of the tin can, the lower cover is removable and the upper cover is adapted to slide within the tin can as adhesive is removed to prevent adhesive from adhering to the inner walls.

The pump is heated and conveys the adhesive composition through a heated line either to a nozzle manifold provided with a plurality, i.e. 1 to 6, horizontally and vertically adjustable slot nozzles or to a selectively controllable connection to a flexible high pressure tube or hose with a nozzle or a nozzle connection comprised of several horizontally adjustable nozzles. The pump is further designed so that it can be restarted with residual adhesive therein even after a prolonged stoppage without first having to be cleaned by providing a trough heater, a by-pass connection and a hand-operated, overrunning starting crank.

The adhesive material is applied in a thin coat through beveled nozzle orifices having a rectangular cross section since the nozzle is rotatably mounted and pressed elastically by elastic feed tubes or spring elements onto the surface to be coated. In this way, the effect of a flat strip of adhesive is achieved which has the advantage that the adhesive also adheres to a wet base, because the grazing nozzle edge in connection with the adhesive pushes away any water film, for example, on a metal roof surface. Moreover, the nozzle ensures a flat and thin adhesive coat which, apart from its economical use, ensures together with the viscosity the initial adhesive which is necessary, particularly on high roofs, to avoid the freshly laid insulation materials from being blown away by the suction of the wind. The nozzles secured on a common nozzle connection can be staggered both in horizontal and vertical direction so that both the distance between the strips on a sheet with trapezoidal corrugations can be varied, and steps of 100 mm and more can be coated.

The device is provided with an undercarriage of several pairs of wheels which are arranged so that sheets with trapezoidal corrugations can be covered in any direction without jolting. The undercarriage may have a finely adjustable brake as well as a stop brake to facilitate driving over inclined surfaces or to prevent it from rolling off the latter.

The heating serves not only, as mentioned above, to facilitate the startup after a prolonged stoppage, but also to heat the adhesive composition to reduce the viscosity briefly to enhance nozzle discharge and the adhesive, especially in the winter so that the advantages of a hot-melting coat can be utilized, if necessary. It is not necessary to heat the container or the hopper which would be very time-consuming in view of the poor thermal conductivity and the generally great sensitivity of the material to high surface temperatures. With the apparatus of the invention, however, the adhesive material which can be stored, for example, over a long period of time at low temperatures, is fully engaged and pressed through a heated thermostatically controlled pipe. The resulting increase in the velocity of flow and in the spec. surface of the material flow results in gentle heating of the adhesive on its way from the container to the nozzle outlet.

Referring to the Figures.

Figure 1:
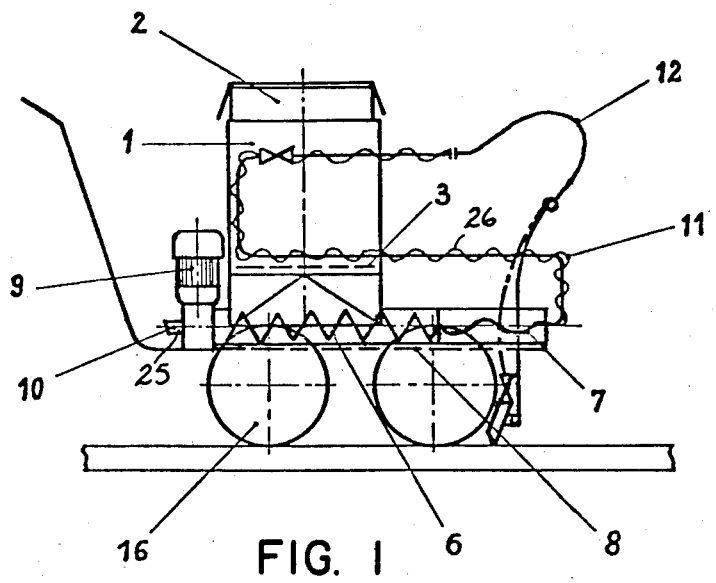
FIG. 1 is a side elevation view of one embodiment of the apparatus of the invention and FIGS. 2 and 3 are a front-end and top view, respectively of the same embodiment.
Figure 2:
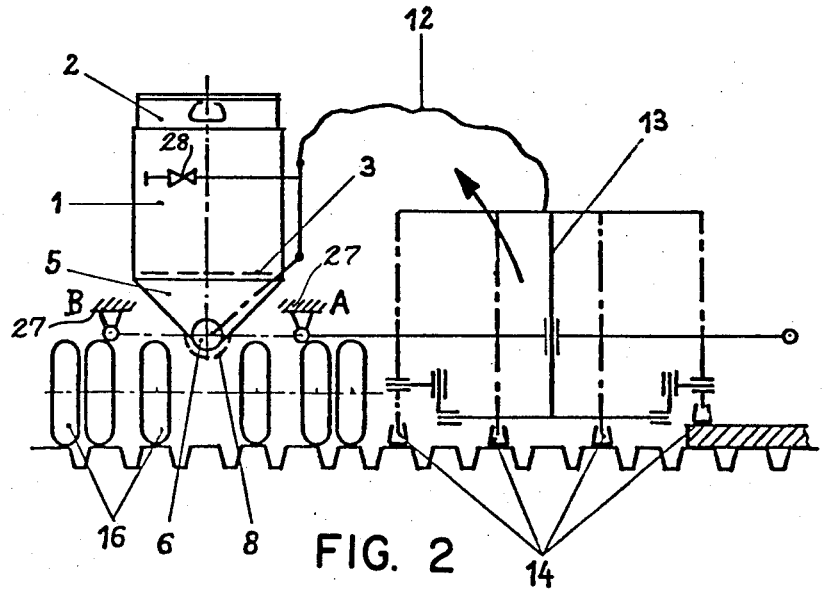
Figure 3:
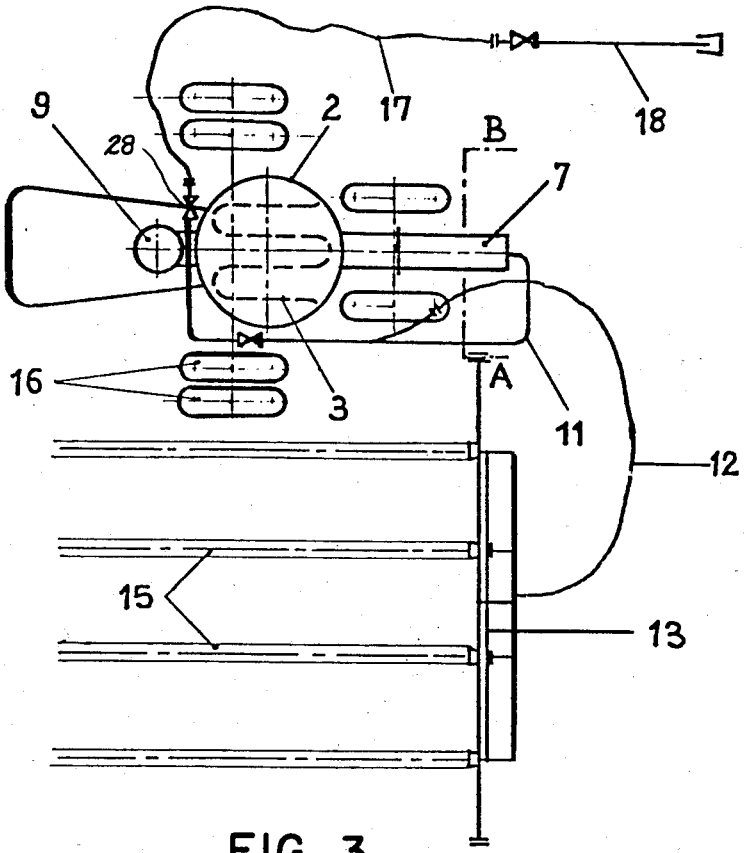

In the embodiment of FIGS. 1 to 3, funnel-shaped charging hopper 1 is filled with a metal container 2 containing the adhesive and provided with a removable top and bottom. The container 2 has a sliding cover which drops as the adhesive is removed from the bottom of the container and which strips any excess adhesive off the inner walls of the container 2. The adhesive composition flows through heatable screen grid 3 into the conical lower part 5 of the hopper 1 which is conical in only one plane over feed screw 6 provided with an opening of 40 to 50 cm×15 cm to pump 7. The underside 8 of the feed screw 6 and pump 7 may be heated to keep the break down point of the driving motor 9 and the size of the said motor within limits at low temperatures of use and after prolonged operational stoppages. A free-wheel safety crank 25 is connected to drive shaft 10 to also assist in starting the apparatus after stoppages and at low temperatures.

Pump 7 forces the adhesive material through U-shaped pipe 11 which thermostatically controls electrically heatable cable 26 and then through flexible tube 12 to application nozzle distributor 13. The arrangement of the application nozzles 14 is illustrated in FIG. 2 and the individual nozzles can be adjusted alone or jointly in a vertical or horizontal direction to allow movement always parallel to the base to ensure that a thin flat coat of adhesive is applied due to its shape and its flexible fastening to the apparatus.

Figure 4:
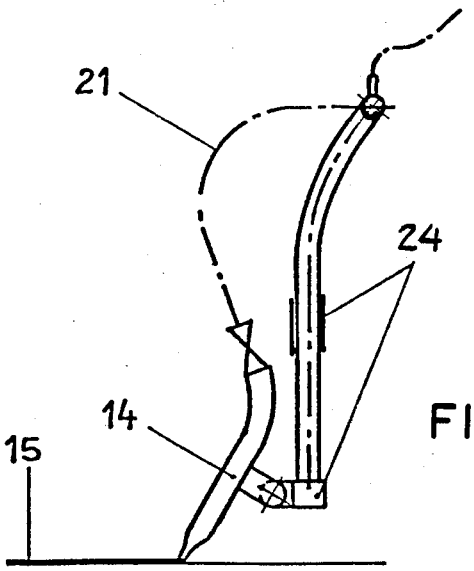
FIG. 4 is a detailed cross-sectional view of the suspension of a nozzle of the embodiment of FIGS. 1 to 3.

As illustrated in FIG. 4, the nozzle 14 is attached to a square shoe 24 to ensure a parallel position and parallel displacement to the surface to be treated. Feed tube 21 used to feed adhesive to the nozzle has a curved form and is arranged so that it is pressed elastically against the surface to which the adhesive is to be applied to obtain an intensive adhesive coating which gives good adhesion even on a wet surface.

Nozzle distributor 13 is suspended at point A of the base 27 for easy transportation by a 90° rotation and may be automatically locked in a vertical position by a ratchet means. The distributor 13 may also be easily disassembled and mounted in a mirror-fashion at point B of the base 27 if required for the operation.

The pump 7 has an undercarriage comprised of several wheels 16 which are preferably arranged in pairs so that undulated surfaces such as sheets with trapezoidal corregations can be easily traversed. As can be seen from FIG. 3, the pump 7 may be connected by a flexible tube 17 to a nozzle 18 which can be hand operated to apply adhesive at narrow points, over lappings, connection, etc. The device may be provided with a closable by-pass connection 28 for attachment to a longer, flexible tube capable of operating, if necessary, a single or multiple nozzle arrangement for treatment of practically inaccessible or steep surfaces. These flexible tubes are connected to feed pipe 11 which is provided with an electrically heatable cable, preferably thermostatically controlled to attain a certain temperature, so that the tubes don't require cleaning even if they have not been used for some time and to ensure an even adhesive flow even at low external temperatures.

Figure 5:
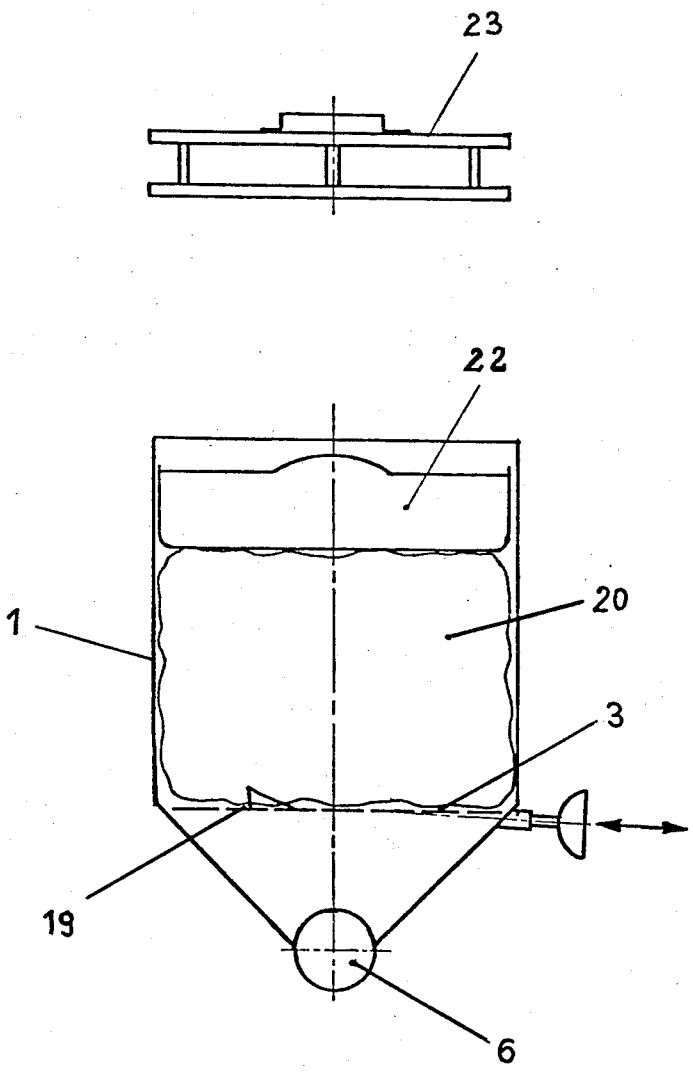
FIG. 5 is a partial cross-sectional view of the hopper of the embodiment of FIGS. 1 to 3 charged with the adhesive packed in a plastic bag.

FIG. 5 illustrates a variation in which the adhesive is packed in a plastic bag 20 which is charged in the closed state to fill hopper 1. In this embodiment, the plastic bag may be opened by at least one fixed blade or a knife 19 moveable from outside the hopper or by a brief surge of electrical current to heatable grate 3 to heat the same to an incandescent state whereby the adhesive is then sucked into the pump. To improve the sealing of the hopper and the stripping of adhesive from the hopper walls, a moveable weight of configuration of 22 or 23 is placed on top of the plastic bag and this embodiment reduces the packaging and disposal expenses.

The apparatus of the invention makes it possible to cement building materials more economically than known apparatus and also under weather conditions which the prior art apparatus could not be used.

Various modifications of the apparatus of the invention may be made without departing from the spirit or scope thereof and it should be understood that the invention is intended to be limited only as defined in the appended claims.

What we claim is:

1. An apparatus for applying adhesive or adhesive pastes in strips on construction or building surfaces comprising a heated hopper container mounted on a traveling positive displacement pump, a manifold at a pump outlet provided with a plurality of application nozzle openings, said application nozzles are mounted slidingly on a base and capable of being adjusted horizontally or vertically and individually or jointly, means for connecting a feed pipe originating at said pump to said application nozzles, said nozzles having rectangular cross-sections and being pressed elastically against said surface in a beveled orientation, said positive displacement pump having a wide intake cross-section and said hopper having a cylindrical upper section and a lower section conical in only one plane with a heatable screen grid in the transition point between said upper and lower hopper sections, said pump being at least partially heated, a drive shaft of said pump being provided with a starting crank and a thermostatically controlled heating means and said hopper being provided with a closable by-pass connection for attachment to a flexible high pressure tube or hose with a single nozzle or multiple nozzle arrangement for treatment of practically inaccessible or steep surfaces.

2. The apparatus of claim 1 wherein the hopper is provided with at least one cutting blade and with a weighted sliding cover.

3. The apparatus of claim 1 wherein the hopper is provided with an electrically heated element which can be heated to incandescent and is provided with a weighted sliding cover.

4. The apparatus of claim 1 wherein the pump is an eccentric spiral pump.

5. The apparatus of claim 1 wherein the nozzles are made of square metal pipe capable of being pivoted and capable of being connected beside the pump.

6. The apparatus of claim 1 wherein an elastic adaptation of the slot nozzles to the base is effected by elastic feed tubes.

7. The apparatus of claim 1 wherein said positive displacement pump has a feed screw with a wide intake cross-section and said feed screw is at least partially heated.

8. The apparatus of claim 1 provided with an electrically heatable cable passing around said feed pipe and connected to flexible pressure tubes.

* * * * *